United States Patent [19]

Mallorca

[11] 4,130,219

[45] Dec. 19, 1978

[54] BEAD SUPPORTED TAB FOR NON-DETACHABLE ENDS

[75] Inventor: Salvador C. Mallorca, Downers Grove, Ill.

[73] Assignee: The Continental Group, Inc., New York, N.Y.

[21] Appl. No.: 853,373

[22] Filed: Nov. 21, 1977

[51] Int. Cl.[2] ..... B65D 41/32

[52] U.S. Cl. ..... 220/270

[58] Field of Search ..... 220/269–273

[56] References Cited

U.S. PATENT DOCUMENTS

| | | | |
|---|---|---|---|
| 3,303,959 | 2/1967 | Brown | 220/273 |
| 3,591,038 | 7/1971 | Mooring | 220/270 |
| 3,863,801 | 2/1975 | Pillnik | 220/270 |
| 4,015,744 | 4/1977 | Brown | 220/269 |

*Primary Examiner*—George T. Hall

*Attorney, Agent, or Firm*—John J. Kowalik; Joseph E. Kerwin; William A. Dittmann

[57] ABSTRACT

A tab for an easy open end which comprises a rivet securing the tab intermediate its ends to the end panel, the tab having a nose end which is adapted to be pressed downwardly upon lifting of the opposite lift end of the tab against a tear-out portion of the end panel and to push the same inwardly. The invention is directed to forming the nose and the lift end of the tab in such manner that both ends of the tab are maintained in constant contact with the container end while it is attached intermediate its ends to the container end panel in order to prevent rocking of the tab and thus producing a fatigue failure in the scored area which is adjacent the tab.

7 Claims, 8 Drawing Figures

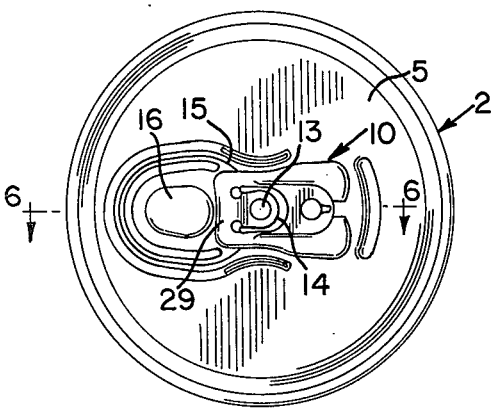
FIG. 1
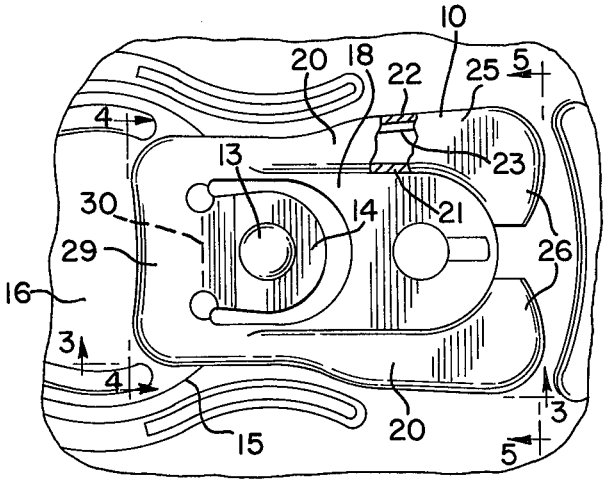
FIG. 2
FIG. 3
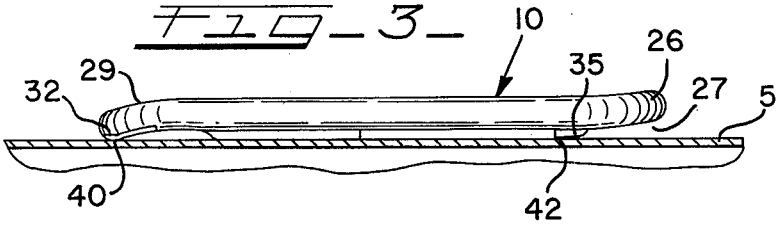
FIG. 4
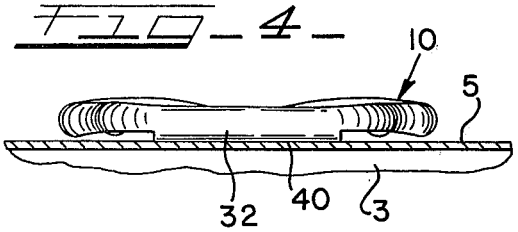
FIG. 5
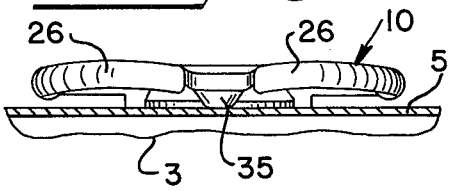
FIG. 6
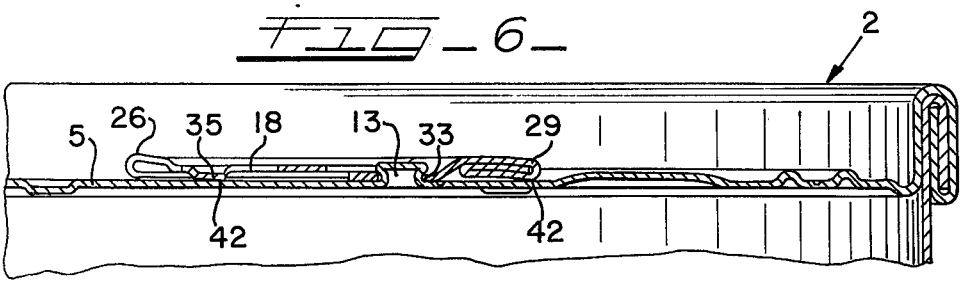

BEAD SUPPORTED TAB FOR NON-DETACHABLE ENDS

DISCUSSION OF THE PRIOR ART

There are known many prior art devices in which tab or the container as provided at the nose portion of the tab with projections either on the tab or on the container which urge the tab upwardly at the nose portion so that the attachment of the tab to the rivet is stressed and the lift portion is angled downwardly against the top of the container.

One of the problems encountered with this solution has been that in bringing the lift end portion downwardly tight against the end panel it is difficult, particularly for women and children, to insert their fingers under the lift portions of the tab and elevate it, pivoting the tab and thus opening the container. A single point contact of the tab at the nose portion also makes the unit extremely vulnerable to accidental opening.

SUMMARY OF THE INVENTION

This invention relates to pull tabs and their construction and association with the end panel of a container.

One of the principal objects of the invention is to prevent rocking motion of the tab and the attaching rivet with respect to the end panel in the vicinity of the rivet which being continuously flexed inwardly and outwardly causes fatigue stressing and premature fracture of the score areas of the openable segment of the container.

The general object of the invention is to provide a novel tab end panel assembly in which the tab is secured intermediate its ends by rivet to the end panel and at opposite ends is provided with means adapted to tightly press against the panel and thereby prevent the rocking motion.

The principal object of the invention is to provide a novel tab which is of simple construction and which comprises a downwardly bent nose portion adapted to engage the top of the container at one end and which has a downwardly directed nib at the lift end of the tab so located that it does not obstruct entry of the person's fingers underneath the tab and which at the same time provides adequate contact of the tab end with the container.

These and other objects and advantages in and encompassed by the invention will become more apparent from the specification and the drawings wherein:

FIG. 1 is a top plan view of a container end and tab combination illustrating the invention.

FIG. 2 is an enlarged fragmentary portion of the top plan of the tab and container.

FIG. 3 is a cross-sectional view taken substantially on the line 3—3 of FIG. 2.

FIG. 4 is a cross-sectional view taken substantially on line 4—4 of FIG. 2.

FIG. 5 is a cross-sectional view taken along line 5—5 of FIG. 2.

FIG. 6 is a enlarged cross-sectional view taken substantially along line 6—6 of FIG. 1.

DESCRIPTION OF THE INVENTION

Figure 7:
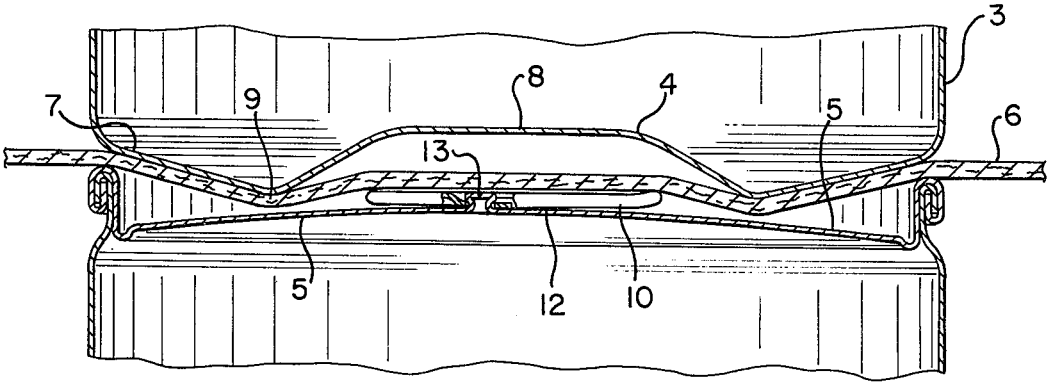
FIG. 7 PRIOR ART
FIG. 7 is the schematic cross-sectional view showing a stacked arrangement of cans incorporating a prior art tab and can end assembly.
Figure 8:
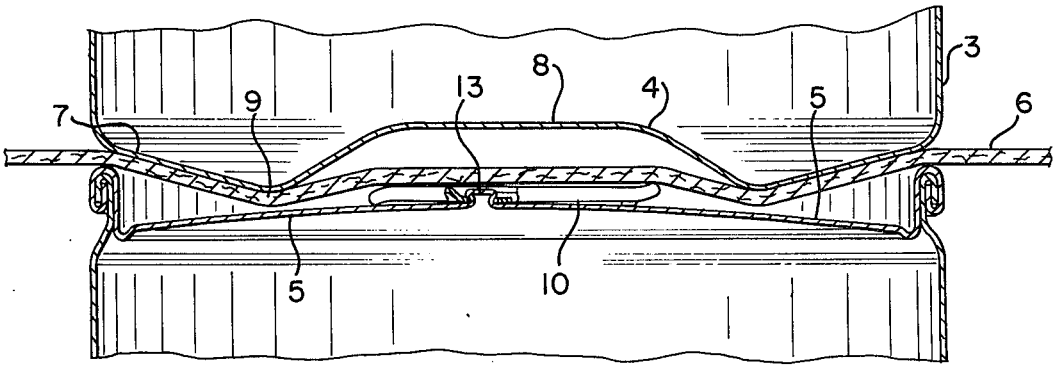
FIG. 8 is similar to FIG. 7 and illustrates the improved assembly 7 with the new tab shown applied thereto.

Referring to the drawing there is shown a container generally designated 2 having a body portion 3 and a bottom 4 which, as shown in FIGS. 7 and 8, is adapted to be stacked in a typical 12-pack container on the top 5 of a similar container therebeneath by being seated on an intervening cardboard separator sheet 6. It will be observed that the bottom profile, chosen for purposes of illustration, comprises a frusto conical outer portion 7 and a domed center poriton 8 which merges with the inner edge of the portion 7 in a seating ring 9 upon which the can is adapted to seat. In the present instance it has been found that this type of container which is conventional causes the separating sheet 7 to drape over the pull tab 10 which is rockably supported on the upwardly domed container end 5 of the pressurized container which could be a can of beer.

The difficulty experienced with this construction has been that in the transport of the filled containers the bottom side 12 of the pull tab 10 which may be flat or downwardly convexed as shown will rock back and forth pivoting with the attaching rivet 13 which is formed inegrally with the top of the container end panel 5 and which extends through a securing ear 14 of the tab 10. This rocking action causes the distended top to flex back and forth prematurely rupturing the score 15 which defines the openable segment 16 of the end panel through which the liquid is adapted to be poured.

A feature of the present invention is the provision of a novel tab which comprises a body protion 18, and flanking rigidifying leg portions 20 which are contoured to provide inboard and outboard vertical webs 21 and 22 inturned bottom flange 23, the inboard and outboard webs 21 and 22 being interconnected by a top web 25. The flat sheet metal body portion 18 is depressed with respect to the legs 20 and the rear ends or wings 26 of the legs are tilted upwardly as best seen in FIG. 2 to provide an access space 27 to permit a person's fingers beneath in order to lift the tab and swing it upwardly thereby depressing the nose portion 29 of the tab downwardly against the panel 16 causing the same to rupture and pushing the panel inwardly as well known to those skilled in the art. It will be observed that the ear 14 is secured to the nose portion 29 along hinge line 30 which is transverse to the length of the tab and that the tab nose portion has a front end 32 which is bent downwardly toward the panel for engagement with the tear-out portion 16. When the tab applied to the end panel and the rivet 14 is staked through the aperture 33 of the tab, the tab is drawn downwardly against the top of the container end panel and the nose 32 engages the portion 16 at one end and the other end of the tab, that is, the body portion thereof, is engaged with the top of the panel 5 through a nib or projection 35 which extends downwardly from the body portion 18 and is disposed centrally between the spaced rear end portions of the legs 20, 20 of the tab in an area forwardly of the end portions 26 in a non-obstructing position to the entry of the person's finger therebeneath. It will be noted that the metal tab has a certain resiliency, be it of aluminum or steel, and that the connection between the tab 14 and the nose portion 29 will affect a bias after staking of the tab so that it rests at its nose at 40 and the nib 35 at 42 against the end panel. Thus the back and forth rocking action of the tab at the rivet 13 causing the rivet to swing back and forth and the ensuing fracture of the score line 15 is entirely eliminated.

Also, the nib is located on the relatively thin section of the tab, the body portion, which is flexible so that upon the tab being struck at the wing portions the body will flex within acceptable parameters without fracturing the end panel. The body section also provides the spring-back reaction against the rivet.

Having described the preferred embodiments of the invention it will be apparent to those skilled in the art that other forms of the structure can be substituted within the scope of the invention as set forth in the appended claims.

What is claimed is:

1. A one-piece sheet metal tab suitable for levering open a tear panel on an end wall of an easy open container, said tab having a rear end spaced above the end panel for easy accessibility and adapted to be lifted to open a tear panel and a front end adapted to be pressed down on the tear panel and a hinge member extending substantially lengthwise of the tab between its ends and hingedly connected at one end to said front end of the tab, and having means on the other end for attachment to the end wall, and means at the extreme opposite ends of the tab in constant abutment with the end panel for holding the tab firmly against the end panel upon securement of the tab thereto for preventing rocking movement of the tab about a transverse axis and thereby flexing of the end panel and premature fracturing of the same.

2. The invention according to claim 1 and said means comprising a panelwardly directed portion on said front end and a projecting nib on the rear end of the tab.

3. The invention according to claim 1 and said means comprising a panelwardly directed portion on said front end and a projecting nib on the rear end of the tab and located inwardly from the terminal portion of said rear end in a position for defining an unobstructed finger-accommodating space with the end panel.

4. The invention according to claim 3 and said rear end of the tab comprising laterally spaced upwardly bent wing portions and said tab having a substantially flat body section terminating longitudinally inwardly of said wing portions, and said nib being formed on said body portion in longitudinal alignment with the space between said wing portions.

5. The invention according to claim 1 and said means comprising a panelwardly directed portion on the front end and a similarly projecting nib on the rear end of the tab and said rear end having outwardly extending end portions, and said nib located lengthwise of the tab inwardly of said end portions.

6. The invention according to claim 5 and said nib being substantially centered between the lateral sides of said tab.

7. The invention according to claim 1 and said tab having a thin body section and said means at one end of the tab being formed on the body section.

* * * * *